US007040551B2

(12) United States Patent
Rummel

(10) Patent No.: US 7,040,551 B2
(45) Date of Patent: May 9, 2006

(54) FOAM, SPRAY OR ATOMIZER NOZZLE

(76) Inventor: Manfred Rummel, Fuchsweg 10, 90411 Nurnberg (DE)

( * ) Notice: Subject to any disclaimer, the term of this patent is extended or adjusted under 35 U.S.C. 154(b) by 244 days.

(21) Appl. No.: 10/240,893

(22) PCT Filed: Mar. 30, 2001

(86) PCT No.: PCT/EP01/03657

§ 371 (c)(1),
(2), (4) Date: Feb. 5, 2003

(87) PCT Pub. No.: WO01/76728

PCT Pub. Date: Oct. 18, 2001

(65) Prior Publication Data

US 2003/0150624 A1 Aug. 14, 2003

(30) Foreign Application Priority Data

Apr. 5, 2000 (DE) ..... 100 16 926
Feb. 16, 2001 (DE) ..... 101 07 826

(51) Int. Cl.
*B05B 1/24* (2006.01)

(52) U.S. Cl. ..... 239/135; 239/138; 239/428; 239/433

(58) Field of Classification Search ..... 239/135, 239/138, 427, 427.3, 428, 428.5, 431, 433, 239/434, 434.5
See application file for complete search history.

(56) References Cited

U.S. PATENT DOCUMENTS 3,946,947 A * 3/1976 Schneider ..... 239/401
4,377,257 A * 3/1983 Geise ..... 239/419.3
4,396,529 A 8/1983 Price et al.
4,830,790 A 5/1989 Stevenson
4,925,106 A * 5/1990 Maas et al. ..... 239/333
5,294,052 A * 3/1994 Kukesh ..... 239/112
5,348,230 A 9/1994 Mullen et al.
5,702,058 A * 12/1997 Dobbs et al. ..... 239/343
6,009,953 A 1/2000 Laskaris et al.
6,217,009 B1 * 4/2001 Rowe ..... 261/78.2
6,561,438 B1 * 5/2003 Restive et al. ..... 239/428.5

FOREIGN PATENT DOCUMENTS

| | | |
|---|---|---|
| DE | 38 41 123 A | 6/1990 |
| DE | 40 29 982 A | 3/1992 |
| DE | 42 37 349 C | 11/1993 |
| DE | 295 05 082 U | 5/1995 |
| DE | 195 37 239 | 9/1996 |
| DE | 196 50 559 | 3/1998 |
| EP | 0 639 408 A | 2/1995 |
| GB | 713 064 A | 8/1954 |
| WO | WO 82/01141 | 4/1982 |

* cited by examiner

*Primary Examiner*—Tu M. Nguyen
(74) *Attorney, Agent, or Firm*—Collard & Roe, P.C.

(57) ABSTRACT

A nozzle for foaming, spraying or misting a first media in the form of a liquid with at least one pressurized second medium, in particular a gaseous or gas-containing medium. An outlet for a foam produced is arranged on the nozzle. The nozzle includes a housing with at least one radially, obliquely, tangentially, obliquely tangentially or perpendicularly tangentially inwardly directed duct for feeding the second medium and a first inlet for feeding the media to be foamed.

51 Claims, 11 Drawing Sheets

FOAM, SPRAY OR ATOMIZER NOZZLE

CROSS REFERENCE TO RELATED APPLICATIONS

Applicant(s) claim(s) priority under 35 U.S.C. §119 of German Application No. 100 16 926.0, filed Apr. 5, 2000 and German Application No. 101 07 826.9, filed Feb. 16, 2001. Applicant also claims priority under 35 U.S.C. §365 of PCT/EP01/03657, filed Mar. 30, 2001. The international application under PCT article 21(2) was not published in English.

BACKGROUND OF THE INVENTION

Nozzle for foaming, spraying or misting

1. Field of the Invention

The invention relates to a nozzle for foaming, spraying or misting a free-flowing medium.

2. Prior Art

It is known that foamed concrete in the construction industry is produced from the foaming materials in a special foaming stirrer. Instead of the foaming stirrer it is also known to use a free-fall mixer. A further method dispenses with foaming agents; the concrete mixture is in this case loosened in a drum provided with tines, pins or teeth. There is also the possibility of producing foamed concrete by pressing air in a free-fall mixing drum.

In the methods outlined, the foam is already produced directly in the storage container area and then has to be conveyed over a relatively long path to the point of use. However, on the path to the point of use there is the risk that the foam will collapse as a result of different effects or merely because of the transport duration per se. For example, the mixer can get into a traffic jam or different external temperatures act on the mixer, so that different conditions are encountered in the area of the "concrete pump". Accordingly, it is not possible at all to predict what foam will arrive at the point of use after a certain conveying path or conveying height. For example, the finished foam mixture has to cover an awkward and long transport path in order to be used in a rough area, for example on the tops of mountains. Accordingly, it is not possible to set the quality and therefore the dry or set bulk density of the foam material reproducibly.

Although it is known always to produce approximately the same foam with the aid of spray containers, such as spray cans or fire extinguishers, this is only possible as long as the respective container is filled with the liquid medium and the propellant. In the case of a greater requirement for foam, such as in the construction industry, the use of such containers is not suitable. In addition, the foaming method cannot be set variably by means of such containers.

DE 195 37 239 C2 reveals a foaming nozzle which has an inlet for the medium to be foamed and an inlet for gas. Also provided is an annular gap and a flow connection between the annular gap and the main flow duct. Furthermore, an outlet is provided for the foam produced within the foaming nozzle, said outlet being located opposite the inlet for the liquid.

Furthermore, U.S. Pat. No. 4,830,790 discloses a foam producing nozzle which, in addition to an inlet and an outlet, is provided with elements that generate turbulence. The apparatus has an inlet opening and an outlet opening Provided in the central area of the nozzle arrangement, as an element that generates turbulence, is a baffle plate provided with openings, downstream of which air intake openings are connected.

In addition, DE-A 38 41 123 A1 discloses a nozzle mixing element for the dry spraying of concrete in the form of a pipe connector, in which bores pointing radially inward are provided in the inner area as injection elements.

Finally, WO 82/01141 reveals a foaming nozzle which has an inlet opening for the introduction of water under pressure and an inlet opening for the introduction, for example, of a liquid detergent. The liquids pass into a main flow chamber at whose end a nozzle is arranged. An outlet opening follows the nozzle. In the area of the nozzle there is an axially displaceable, pin-like nozzle core, which can be displaced both into an active foaming position and, in this position, rests substantially in the nozzle. If the nozzle core is withdrawn axially from the nozzle, it is located in a passive position, which permits a free flow of the liquid produced through the nozzle to the outlet duct.

SUMMARY OF THE INVENTION

The invention is therefore based on the object of developing a nozzle for foaming, spraying or misting and a method by means of the nozzle for foaming, spraying or misting liquid media in particular, to the extent that a reproducible quality of the foamed, sprayed or misted material is possible and can be set on site, it being possible even for relatively large quantities of this material to be produced.

The object is achieved by the features of the nozzle as shown and described. Advantageous developments of the nozzle are also disclosed. A foaming unit according to an embodiment of the invention which comprises the nozzle is disclosed. Expedient refinements of the foaming unit are further disclosed. The invention is additionally achieved by a method of foaming by means of a nozzle as shown and described. Advantageous developments of the method are also disclosed Advantageous uses and developments of the nozzle are shown and described as well.

The nozzle according to the invention for foaming liquid first media, in particular, by means of at least one pressurized second, in particular gaseous or gas-containing medium, comprises a housing in which at least one radially inwardly directed duct for feeding the second medium and also a first inlet for feeding the first medium to be foamed are provided. The second medium (in particular gas) flowing in through the at least one radially inwardly directed duct produces vortices with the first medium (in particular liquid), the first medium being foamed. Immediately after the foaming, the foamed material emerges at the outlet or at the end of a line connected thereto and is ready to be used for the respective application.

The dry or set bulk density in foamed material can therefore be set accurately. Because of its compactness and its relatively low weight, the nozzle can be handled easily. The foam is therefore produced in the foaming nozzle directly before its use, it being possible to choose the foam-generating media freely. Because the foaming takes place directly at the point of use, any loss in quality, such as arises in the case of conventional pumps of foamed materials, is avoided, which means that reproducible foam properties can be set.

By means of the nozzle, any desired quantities of the initial media can be foamed, so that a continuous foaming method is also possible. The nozzle additionally provides the possibility of processing with one another to form foam materials which are intrinsically not particularly highly compatible and, during relatively long storage, tend to clump or gel. These materials are only connected with one another at the point of use and are then processed immediately as foamed material. In addition, the material is not discharged as the result of pump pressure but by the gas pressure of the ducts, that is to say the material is not previously destroyed but, on the contrary, loosened again.

In addition, provision is made for the nozzle for foaming a free-flowing medium to have an annular component which is arranged in the housing of the nozzle, the annular chamber being bounded by the nozzle and the annular component. According to the invention, the annular component is designed as a separate replaceable part, the flow connection comprises at least one duct in the annular component, and the duct runs obliquely with respect to the main flow direction. The gas or gas-containing medium flowing in through the duct running obliquely with respect to the main flow direction produces vortices with the free-flowing media, the free-flowing media being foamed. Immediately after foaming, the foamed material emerges at the outlet or at the end of a line connected thereto and is ready to be used for the respective application.

Because the annular component is designed as a separate replaceable part, it is possible to clean any blocked or contaminated ducts on the dismantled annular component. For different intended uses, the annular components can expediently be replaced. Because the ducts are integrated in the annular component, the foaming nozzle can be configured simply, so that the production costs are kept low. Provision is particularly advantageously made for at least one duct directed radially or obliquely or tangentially inward to be integrated on an annular component arranged in the nozzle. Thus, the separate component can be provided in a simple way with one or a plurality of the inwardly directed ducts.

On the nozzle, at the side, at least one second inlet can be provided for feeding the second or else further media, from which inlet the second medium is passed onward into the inwardly directed ducts. In this case, this second inlet can be provided with a thread, in order to screw on the feed line for the in particular gaseous media in a simple and stable manner.

Between the annular component and the nozzle housing, an annular chamber can be provided, which the inwardly directed ducts adjoin. Accordingly, the medium introduced through the second inlet, in particular gas, is firstly distributed in the annular chamber and fed to the ducts in a uniform distribution. This achieves a uniform formation of foam in the nozzle.

The second medium can also be fed via a continuously adjustable annular chamber and/or adjustable ducts, so that the flow conditions, for example the flow pressure, can be matched to the different media, and therefore the desired formation of foam can be set flexibly.

Furthermore, it is possible to set the internal diameters both of the first and of the second inlet, of the outlet and of the annular component in such a way and to match them to the relationship between liquid guidance and foaming behavior in such a way that the foaming result is always optimal.

The first inlet for the feed line of the medium to be foamed and the outlet for the foamed material can be arranged opposite each other in the main flow direction. The nozzle can therefore be constructed simply, at the same time the optimum formation of foam and discharge of the foam being ensured.

The inwardly directed ducts can advantageously be oriented substantially counter to the feed line of the medium to be foamed. This can be advantageous for thin media to be foamed, in order that these are mixed and swirled adequately with the gaseous medium, so that the material is foamed to the required extent.

However, it is also possible for the ducts to be oriented substantially in the main flow direction, with which in particular more viscose mixtures, such as a cement-water-foaming agent mixture, can be foamed. This orientation of the ducts additionally leads to an additional acceleration in the discharge area, so that the suction effect of the gas introduced under pressure also sucks the hose or the pipeline connected to the nozzle empty at the same time. In addition, as a result the ducts remain clean and do not become blocked. As a result of orienting the ducts in the main flow direction, the nozzle can advantageously be cleaned, the compressed gas or the compressed air being added until all the material has been discharged.

The ducts can be configured as round bores, which can be made in a simple way in the annular component. In addition, round bores ensure an optimum flow pattern of the gaseous or gas-containing medium.

The annular component can particularly advantageously be turnable, so that it can be used for different purposes. By means of the turnable component, accordingly, both liquid media with different viscosities can be foamed or the nozzle can be cleaned in the manner outlined above.

Differently configured annular components can expediently be insertable into the nozzle, so that the foaming can be matched to the media or materials respectively introduced. By means of differently configured annular components, the degree of foaming can also be varied.

If the annular component is sealed off on the inner wall of the nozzle, flow losses can be avoided. In addition, the seals can prevent the foamed material emerging laterally from the nozzle.

The nozzle can be built up in one or two parts or many parts, the annular component being arranged substantially between the parts. The annular component can thus be inserted simply into the nozzle, the parts having a simple construction. The parts can be identical in terms of their dimensions, that is to say both in terms of their taper length and in terms of their diameter. It is thus possible to use the nozzle in two directions, depending on the application, without having to turn the annular component.

The parts of the nozzle can expediently be joined so that they at least partly overlap, the annular component being arranged between a circumferential protrusion on the one part and the end face of the other part. In the case of the arrangement of two parts, these can have threads in order to screw them. As a result of the partial overlap or screwing, the nozzle is built up stably around the foaming area, and at the same time the annular component is held securely and firmly in its position by the two parts. In addition, by means of the construction the two parts and the annular component can be plugged into one another in a simple way in order to set up the nozzle.

The seal already explained above can be provided between the annular component and the circumferential protrusion and/or the annular component and the end face. By means of the specific arrangement of the seal, this can be replaced simply in the event of wear.

On the nozzle, a heating apparatus can be provided in order to heat the foamed material, in order that the latter is imparted improved processing properties. For example, a temperature-controlled foam can have improved adhesion properties, curing properties, cleaning effects, setting properties and so on. However, with the aid of the heating apparatus it is also possible to heat the media fed in, it being possible to imagine in particular that the gas or gas-containing material fed in is heated, so that improved foaming is achieved.

Furthermore, it is also possible to fit a UV emitter, for example in the outlet area of the nozzle, in order to illuminate the foamed plastic material discharged there, which then cures. This is advantageous, for example, if the nozzle is dragon through a sewer pipe in order to perform pipe coating from the inside. The foamed material therefore cures immediately after application.

In a nozzle for foaming, spraying or misting, as described above, the nozzle is connected to the storage containers of the individual media via lines (for example hoses). In this case, the lines have different lengths, as required. With the aid of the foaming unit, continuous feeding of the individual media, and therefore continuous foam generation, is possible with constant quality.

The nozzle can be assigned a metering appliance for the metered mixing in of a plurality of initial components, which are then fed to the nozzle as a mixture (for example as first medium). For example, a foaming agent with a water jet fed in can be mixed in at the metering appliance. Of course, it is also possible to introduce a number of different media simultaneously or one after another into the metering appliance.

Lines for different initial components can be provided on the metering appliance, in order to permit appropriately accurate metering.

The metering appliance can operate, for example, with a hydraulic drive and is therefore constructed relatively simply. In this case, a hydraulic motor is used, that is to say the water pressure moves a metering plunger belonging to a metering pump, as a result of which the respective medium, for example the foaming agent, is mixed in. With the aid of the metering appliance, quantities of foaming agent and additives can be metered in, depending on what requirements are placed on the medium to be foamed. Different quantities of foam and weights of foam can be produced continuously via the amount of media metered in.

The metering of different initial components can expediently be set exactly at the metering appliance, so that the same composed mixture always flows to the nozzle. In this case, the metering can expediently be adjusted, for example by means of the hydraulic drive. In addition, however, there can always be the possibility of providing external metering at a point in the line downstream of the metering appliance. This can be expedient in particular in media which are problematic with regard to material compatibility.

Advantageously, at least one pressure regulator and a flow regulator for the defined passage through and flow rate through the respective medium may be connected upstream of or to the nozzel. A pressure regulator and a flow regulator are primarily provided on the line of the second medium with whose pressure the foaming or mixing in the nozzle is achieved, in order to control the foaming process.

One foaming nozzle (I) can particularly advantageously be connected to at least one second foaming nozzle (II). In this case, the foaming of different media or materials, which are difficult to foam or cannot be foamed at all, is carried out with the aid of a foam previously generated in the nozzle I. This is then fed to the nozzle II through which the material to be foamed is led via at least one inlet, which is otherwise provided for the feeding of a gaseous medium. This embodiment can be used in particular when foaming materials and material mixtures which are difficult to foam. In this case, the second medium is therefore the foamed material, the first medium representing the materials or material mixtures. It is therefore not a liquid medium which is foamed, but materials that are mixed with a foam, while increasing or maintaining the foam formation. The expedient foaming unit can likewise be used for the bonding and the dust-free transport of for example, mineral fibers, cellulose flocks and the like. Likewise, dust-free (or freer) bonding or transport of, for example, toxic, aggressive or explosive substances for further use or disposal is conceivable.

The nozzle can be followed by a remixer, with which, for example, materials that are difficult to foam with one another can be mixed. For example, it may arise that, for example, a cement foam to which proportions of fiber have been added "spits" out of the annular component and therefore does not run uniformly. This "spitting" or the irregular discharge can be suppressed by a remixer. Accordingly, therefore, for example the cement foam initially foamed is then mixed with the proportions of fiber, so that a homogeneous foamed mass is obtained. In this case, the remixer can be configured in a conventional, mechanical design.

The method according to the invention for foaming an in particular liquid, first medium by means of at least one pressurized second medium is defined by the fact that the second medium is introduced in an annular component through at least one radially or obliquely or tangentially inwardly directed duct and foams the first medium fed in through another inlet. The second medium introduced radially, obliquely or tangentially, which may be a gas, for example, produces swirling with the first medium in the annular component in such a way that foaming takes place. The foaming can take place directly at the working point of use by means of the method according to the invention, so that a constant foam quality is ensured. In addition, continuous foaming is therefore possible.

The components fed to the annular component can be heated previously or in the component, it being possible for better foaming of the material to be achieved. It is also possible to heat the already foamed material, which may be advantageous, depending on the area of use.

Before being introduced into the annular component, the first medium to be foamed can have a foaming agent added to it, in order that the foamed material remains stable and does not intrinsically collapse so quickly The respective initial media can be fed to the nozzle under control, so that both the composition and the degree of foaming of the foamed material can be set.

In specific cases, depending on the type of materials used provision can be made for the foamed material to be remixed with at least one other material. This is advantageous, for example, when the two materials would cause a blockage of the nozzle.

It is also possible for at least one medium to be fed to the nozzle as a foamed material. This can be advantageous, for example when foaming materials which are difficult to foam.

Following application, the foamed material can cure, which will be the case in particular, for example, in the case of constructional materials or plastic.

When the nozzle is used for the production of constructional materials, for example, the constant quality of the foamed material and the continuous, foam production is primarily important.

The nozzle can also be used to foam plastics, for example. Following the foaming operation, the foamed plastic can be irradiated with UV light, so that said plastic cures immediately after application. One advantageous use of the nozzle is also possible, for example, in the inner coating of pipes. The nozzle can also be used for cleaning and disinfection by means of the foaming material.

In the following text, still further advantageous areas of use and application of the nozzle are listed by way of example:

Bonding of substances by means of foam, transport of substances by means of foam, fire extinguishing technology, production of watertight foams, long-term binding agent, plaster-bonded material mixtures for foams and granulates, open-pored foams with solid structures, and also application of the foaming nozzle for filling trenches, shaft structures, cavities, production of foams in the processing of foodstuffs, pharmaceutical industry, cosmetics industry, detergent and cleaning agent industry.

In a further refinement of the nozzle, provision is made to design the insert element as an annular, separately replaceable component, which forms a central section of the main flow duct. The ducts are arranged obliquely with respect to the main flow direction and, in particular, form two separate groups, the ducts of one group pointing obliquely in the direction opposite to the ducts of the other group and obliquely with respect to the main flow direction.

The two groups of ducts can either be connected simultaneously or alternatively to two separate inlet ducts or—if one of the housing parts has no inlet duct—can be connected to the inlet duct as a result of rotation of the annular component.

As a result of the arrangement of two groups of ducts, the area of application of the annular component is widened extensively. Depending on how the groups of ducts are arranged, what diameter the ducts have, what angle they have and how many of the ducts there are, the result is different mixing or foaming effects within the area of use, so that an extremely wide range of materials, foam densities or spray mist densities can be produced. The medium additionally fed in can optionally be fed in either counter to the outlet direction or in the outlet direction. If two further inlet ducts are present, the insert element serving as annular component does not need to be rotated. By means of closing one duct and feeding the medium through the other duct, the injection direction is turned around, as based on the main flow direction.

The annular component formed as an insert element can be designed mirror-symmetrically with respect to the arrangement of its bores. This is recommended when the different groups of ducts are intended merely to be used to turn around the injection direction of the medium.

In this case, the annular component can have two circumferential annular chambers at its ends, in the region of its front sides, their open groove outer sides being aligned with the further inlet ducts. The annular chambers can have a wedge-like, rectangular or round cross section, which is beneficial to the deflection of the medium in the direction of the ducts. The bottoms of the annular chambers in this way form wedge faces, for example, which run from the front sides of the annular component to the inlet openings of the ducts.

The nozzle can be produced particularly simply it the two housing parts rest on one another in a sealing miner with their front sides enclosing the annular chamber. In order to improve the sealing and in particular to rule out play of the annular component in the holding chamber, it is possible to arrange a ring-like resilient sealing element in the joint area between the two housing parts. In this case, the two housing parts can be clamped together by means of screws and exert pressure on the front sides of the annular component. The two housing parts can have inlet and outlet ducts that are aligned with the duct in the component. However, it is also possible for a first housing part to have an outlet or inlet duct which is substantially aligned with the duct in the component, and for the other housing part to be provided with a mixing chamber like a blind hole, into which the first inlet opening enters laterally. A design of this type is suitable in particular for spray cans, for example, the entire nozzle then being miniaturized.

The inlet and outlet ducts aligned with the duct of the component can widen in the manner of a cone or trumpet toward their outlet ends.

At the inner end of the outlet duct, a grid or screen element provided with a plurality of openings can additionally be provided, in order further to assist the formation of foam, if the nozzle is used for forming foam. The two housing parts are constructed in such a way that they can be mounted on each other at different rotational angles. Overall, a round, polygonal or square cross-sectional shape can be provided. As a result of mounting different rotational angles, the relative positions of the inlet ducts in relation to one another can be chosen freely, so that the nozzle can be adapted particularly simply to its surrounding elements.

Finally, an alternative nozzle of extremely simple design results from arranging a tubular housing with a foaming zone and having an inlet and outlet in each case, formed by the central opening and arranged coaxially in relation to each other, for the passage of the first medium and at least one duct, formed obliquely at an acute angle $\alpha$ in the housing wall and opening into the central opening of the housing in the area of the foaming zone, for feeding the second medium. In this case, the tubular housing acts as a nozzle in which the foaming or the first medium is carried out in the opening area of the duct or the ducts. Two separate groups of ducts are preferably provided in the housing, the ducts of one group being aligned obliquely in the direction opposite to the ducts of the other group, and the ducts of one group being directed in the main flow direction of the first medium, and the ducts of the other group being aligned in the direction opposite to the main flow direction of the first medium.

Alternative nozzles are given by single-part configurations according to FIGS. 8–13.

BRIEF DESCRIPTION OF THE DRAWINGS

The invention is explained in more detail using advantageous exemplary embodiments in the drawing figures, in which.

BRIEF DESCRIPTION OF THE INVENTION

Figure 1:
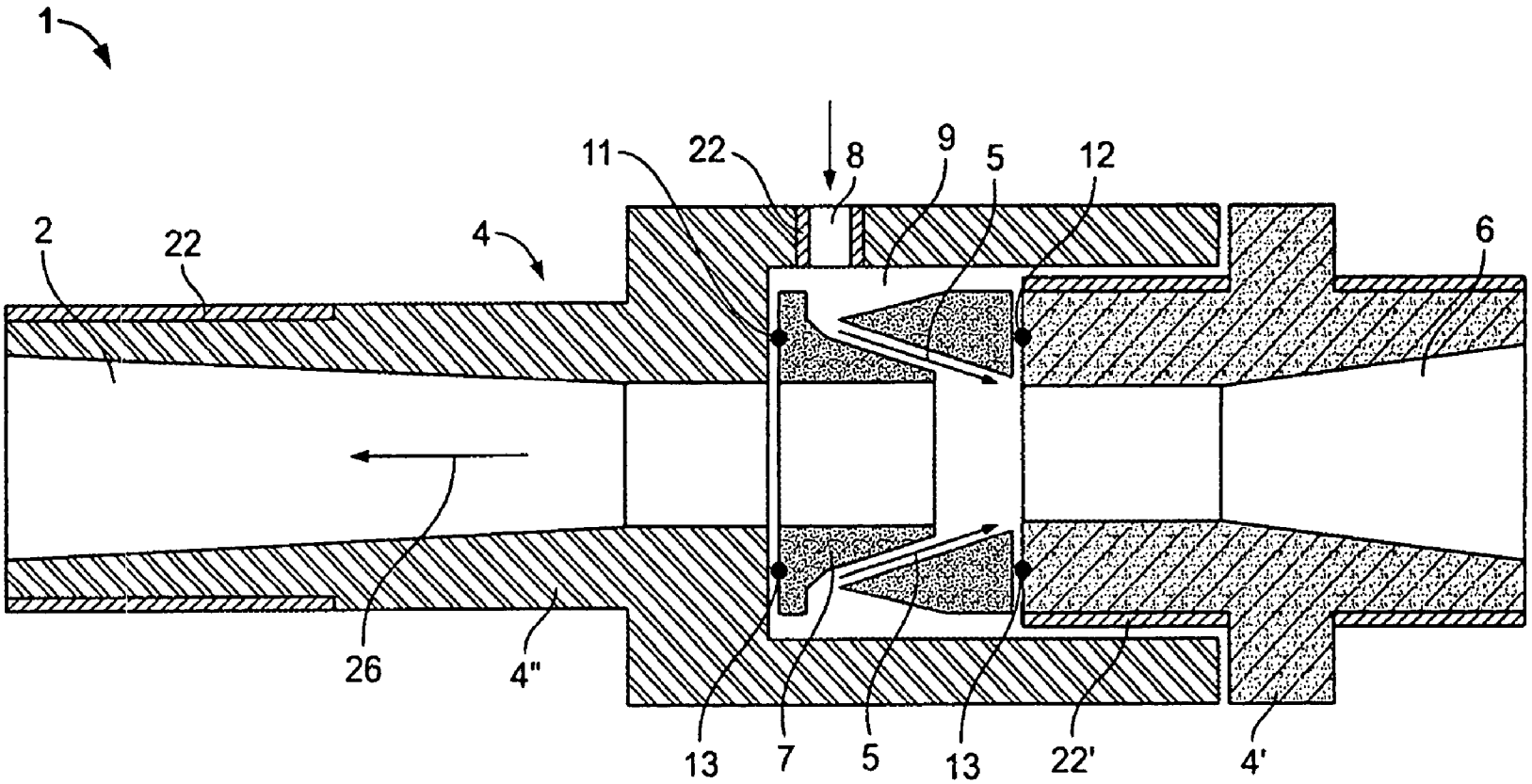
FIG. 1 shows a nozzle in section.

The designation 1 designates the nozzle in its entirety. The nozzle comprises a housing 4 with an annular component 7, in which radially inwardly directed ducts 5 for feeding a second medium, in particular a gas, and a first inlet 6 for feeding the medium to be foamed, and an outlet 2 are provided. The gas flowing in through the ducts 5 produces swirling with the medium fed in through the first inlet 6, so that said medium is foamed. The nozzle can be used irrespective of location, the foaming taking place directly at the working point of use. The advantage is constant quality of the foamed material, continuous foaming being possible at the same time.

The inwardly directed ducts 5 are integrated in the component 7. As a result, the ducts 5 simply have to be bored into the component 7. A second inlet 8, which is arranged laterally on the housing 4, serves for the introduction of the gas, which flows into the inwardly directed ducts 5. Threads 22 for the tight connection of lines are provided on the inlet 8 and the inlet and outlet 6, 2. Formed between the component 7 and the housing 4 is an annular chamber 9, which is adjoined by the inwardly directed ducts 5. The gas flowing in at the second inlet 8 is thus firstly distributed over the annular chamber 9 and then flows through the radially, obliquely or tangentially inwardly directed ducts 5 into the interior of the component 7. The annular chamber 9 can be adjusted continuously, so that the flow conditions, for example the flow pressure, can be set variably. The annular component 7 can be constructed in such a way that when the annular chamber 9 is adjusted, the inwardly directed ducts 5 are also adjusted at the same time. In this case, it is possible for both the length and the diameter of the ducts 5 to be adjustable.

The first inlet 6 and the outlet 2 are arranged opposite each other in the main flow direction 26, so that no flow losses occur in the foamed material and a simple structure of the housing 4 is made possible. The ducts 5 are oriented substantially counter to the main flow direction, and the gas introduced through them, with the medium flowing in, produces increased swirling, which is necessary in particular in the case of thin media, in order to arrive at the desired foaming.

However, it is also possible for the ducts 5 to be oriented substantially obliquely in the main flow direction, which is advantageous for more viscose mixtures. This also leads to an additional acceleration in the discharge area, which is advantageous in particular when cleaning the housing 4.

The ducts 5 are as a rule configured as round bores and therefore permit optimum flow conditions. The annular component 7 can be inserted flexibly and replaceably into the housing. For different applications, it is possible to insert differently shaped components 7 into the housing 4.

The annular component 7 is sealed off on the inner wall of the housing 4, so that optimum swirling remains guaranteed in the housing 4 and, at the same time, no material can penetrate to the outside at undesired points.

Figure 5:
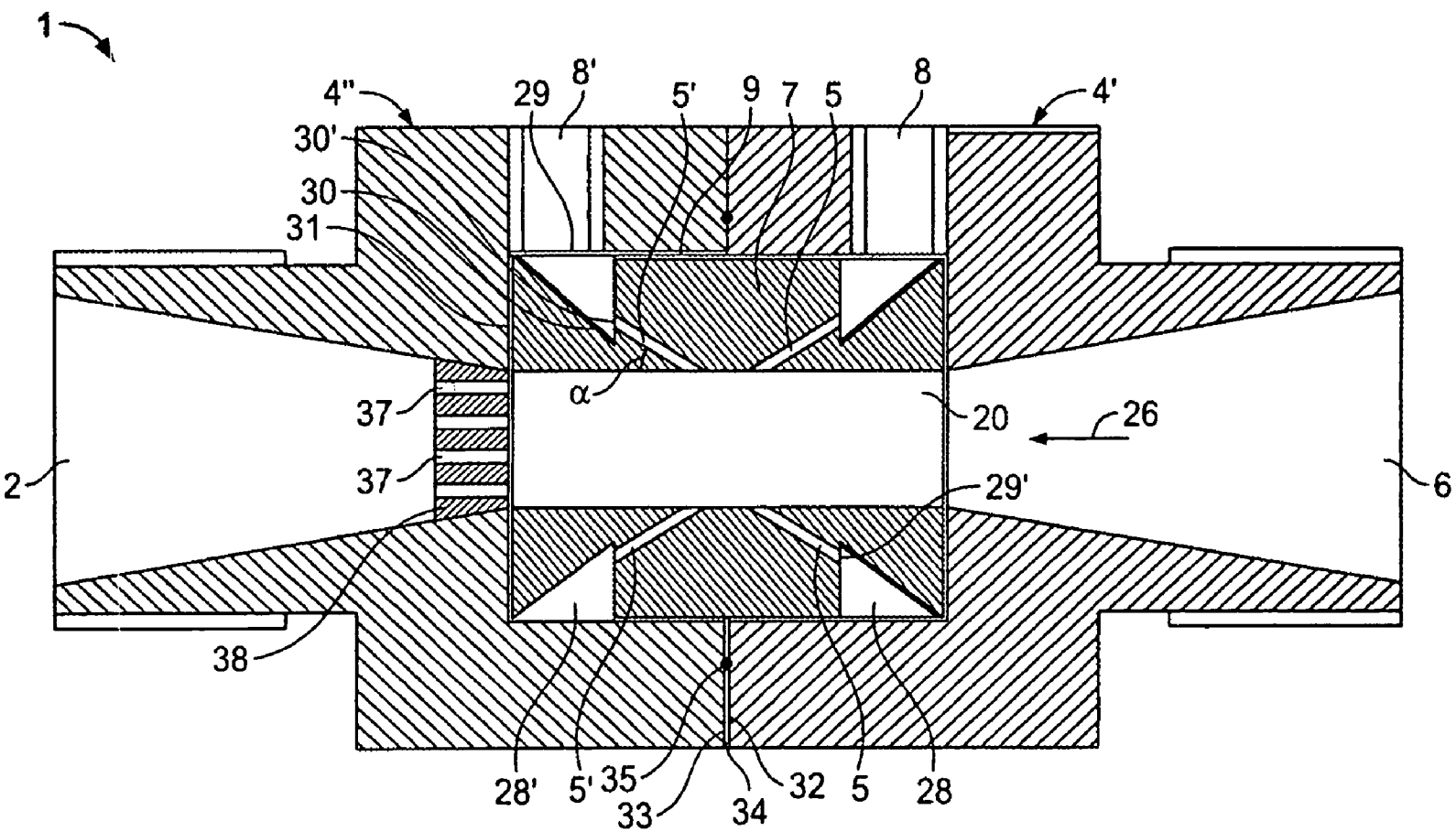
FIG. 5 shows a nozzle according to a further design in section.
Figure 6:
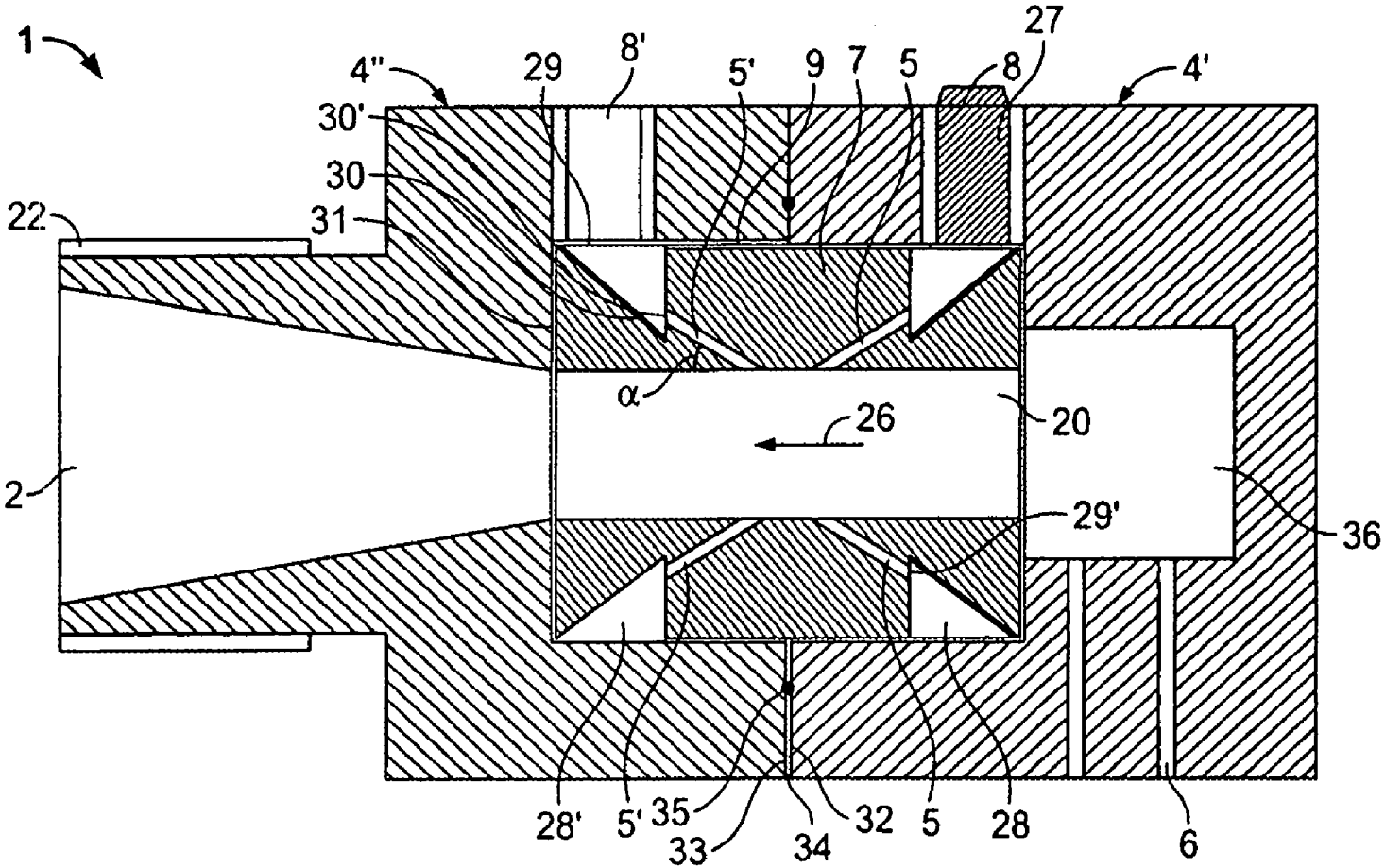
FIG. 6 shows a nozzle corresponding to a modified design in section.

The housing 4 of the nozzles of FIGS. 1, 5 and 6 comprises two parts 4', 4", between which the component 7 is arranged. The two parts of the housing 4 are in this case screwed to each other via a thread 22', the component 7 being arranged between a circumferential protrusion 11 on the part 4" and the end face 12 of the part 4'. The two parts 4', 4" are constructed simply and at the same time ensure secure retention of the component 7. The abovementioned seals 13 are in this case provided between one end of the component 7 and the circumferential protrusion 11 and between the other end of the component 7 and the end face 12.

For appropriate applications, a heating apparatus and/or a UV emitter can be provided on the nozzle 1, but these are not illustrated in the drawing figures. By means of the heating apparatus, the initial components or the foamed material can be heated or UV-irradiated.

Figure 2:
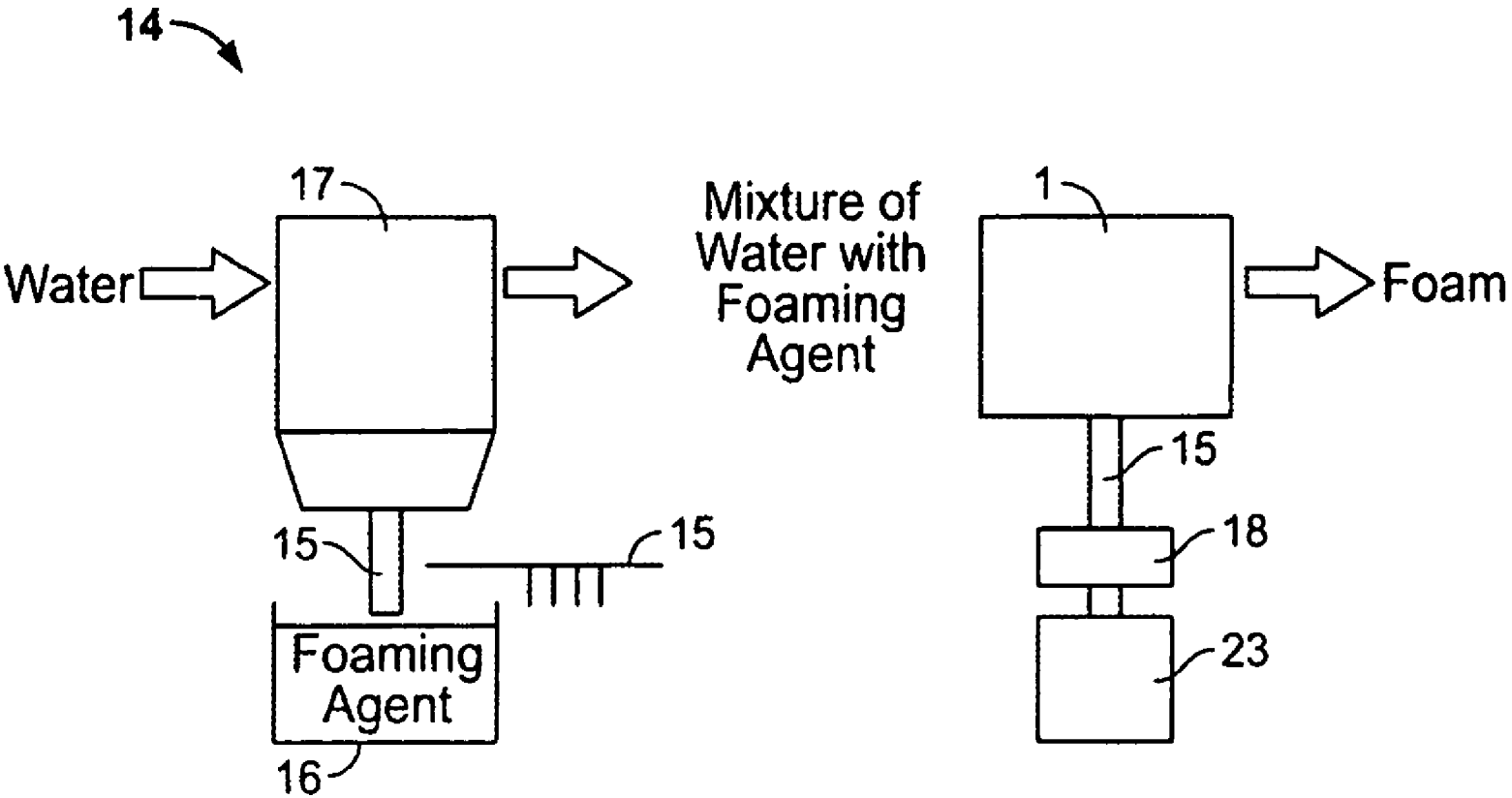
FIG. 2 shows a basic illustration of a nozzle.

The foaming unit illustrated schematically as a flow diagram in FIG. 2 comprises a nozzle 1, which is connected via lines 15 to storage containers 16 of the various initial components. In the foaming unit according to FIG. 2, for example water is initially mixed with a foaming agent and then foamed by means of compressed air to form foam. Connected upstream of the nozzle 1 is a metering appliance 17, which operates with a hydraulic drive. The metering appliance 17 has a hydraulic motor, that is to say the water pressure moves a metering plunger of a metering pump, as a result of which the foaming agent is mixed in. In addition to mixing in the foaming agent, there is also the possibility of mixing in other media to the metering appliance 17 or a line 15 connected thereto. The accurate metering can expediently be set at the metering appliance 17. For the feed line of the gas, a compressor 23 and a pressure regulator 18 following the latter is connected to the nozzle 1 for the defined feeding of the gas. By means of the pressure regulator 18, the level of foaming can be set. The line 15 between the pressure regulator 18 and the nozzle 1 has a nonreturn valve, in order to prevent reverse flow of the gas or of the foamed material.

Figure 3:
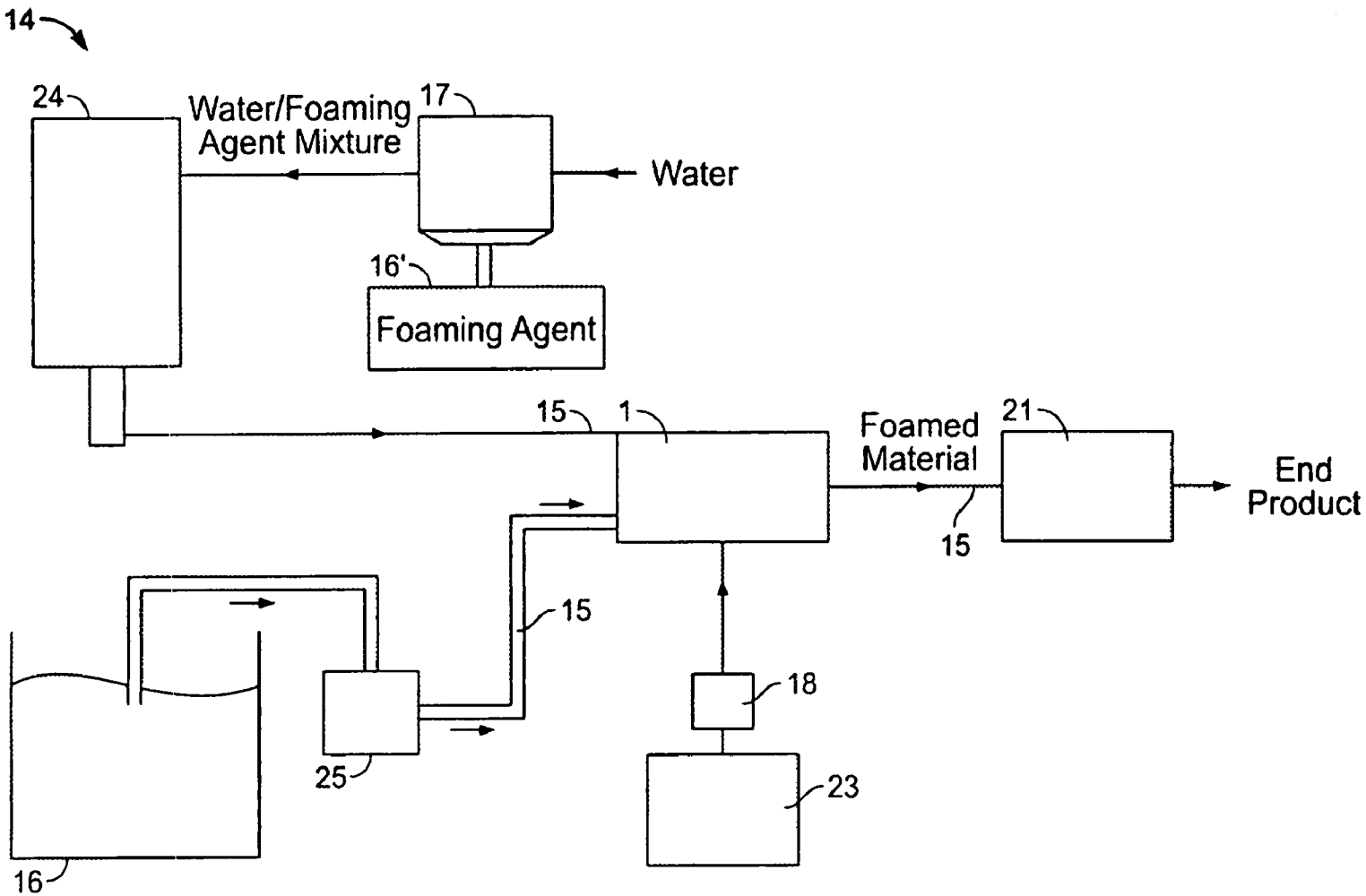
FIG. 3 shows a basic illustration of another embodiment of a nozzle.

The nozzle 1 of the foaming unit 14 illustrated in FIG. 3 is fed with substantially two different initial materials for foaming. By means of the foaming unit 14, various foams with solid structures (similar, for example, to lightweight porous concrete) can be produced for all hydraulically setting materials and material mixtures (for example cement, plaster, chalk, magnesite and so on). The water-foaming agent mixture led out of the metering appliance 17 is fed, for example, to a mortar mixing machine 24. In the storage container 16, there is the material to be foamed, which can be a prepared mixture mixed separately or delivered by transport vehicles, if appropriate with foaming agent and various additives. This prepared mixture is fed by means of the pump 25 to the nozzle 1 and foamed there by means of the gas flowing in. The foamed material finally passes into a remixer 21, in which materials which are difficult to foam are added.

Figure 4:
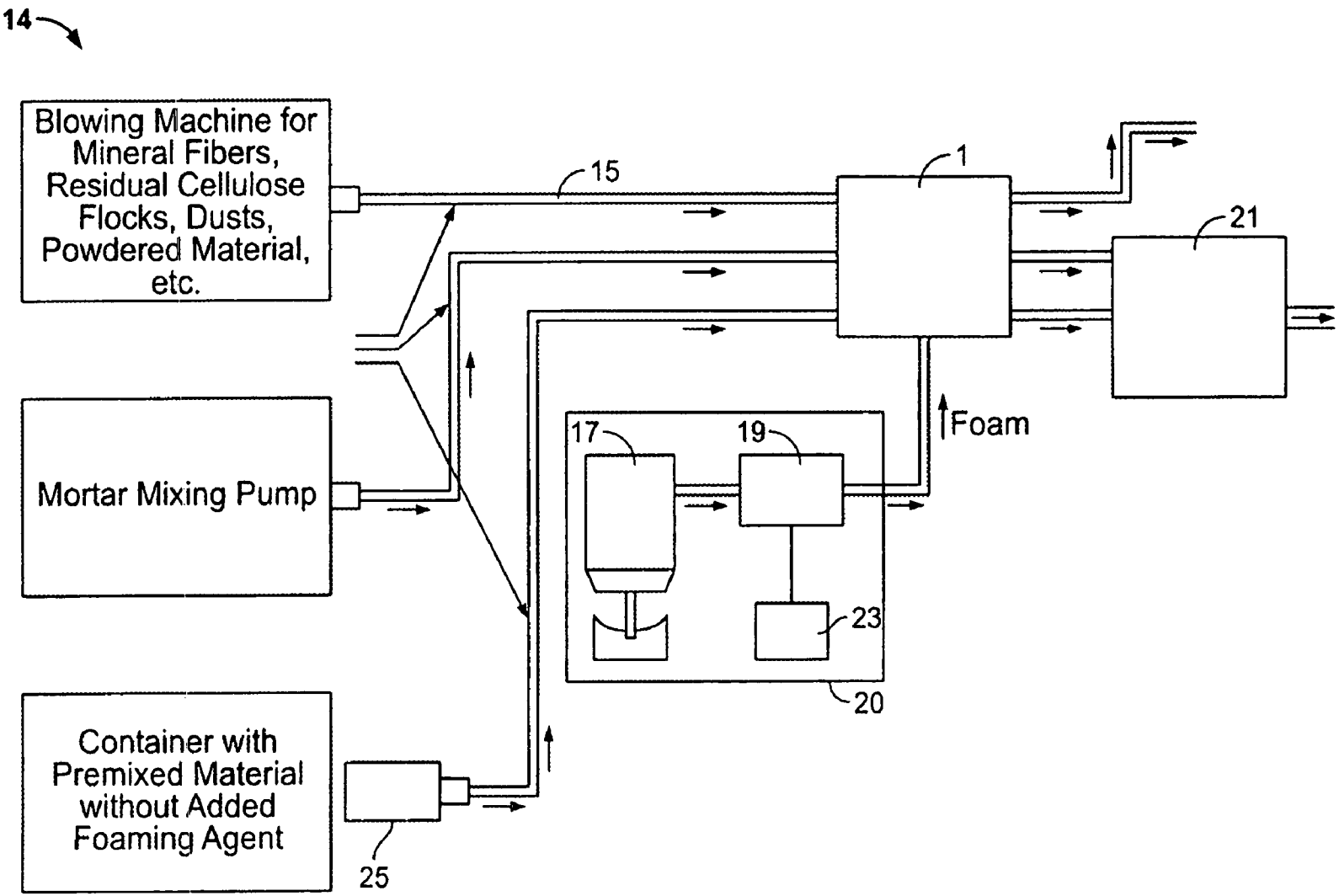
FIG. 4 shows a basic illustration of a further design variant of a nozzle for various application methods.

FIG. 4 reveals a particularly advantageous variant of a foaming unit 14. Connected to the nozzle 1 provided there is a second nozzle 19 or foaming unit 20, foaming being carried out by means of the foamed material from the second nozzle instead of compressed air or compressed gas. The already prefoamed foam therefore enters the housing 4 of the nozzle 1 through the inwardly directed ducts 5, 5'. The material to be foamed is fed in via the second inlet 8. Thus, for example starting from a blowing machine, for example mineral fibers, residual cellulose flocks, dusts, powdered material, etc. can be bonded or transported without dust by means of the foaming. Materials and material mixtures that are difficult to foam can also be fed in via the second inlet 8 for foaming. The foaming unit 14 can also be used for the dust-free bonding or transport, for example, of toxic, aggressive or explosive substances, for their further use or disposal.

The nozzle 1 can, for example, also have connected upstream of it a mortar mixing pump or a silo with a mixing pump, in order to feed the material to be foamed to the nozzle 1. In the last possibility illustrated in FIG. 4, a container with premixed material without the addition of foaming agent is provided, the premixed material being fed to the nozzle 1 by means of a pump 25. The material foamed in the nozzle 1 is either discharged directly by means of a spray hose or previously further fed to a remixer 21.

On their path through the lines 15, the initial materials can have further substances added, which is illustrated by appropriate arrows.

During foaming, it is possible for at least one initial medium to be heated before the feed line to the housing 4 or in the housing 4 itself. This can lead, for example, to an increased level of foaming. However, it is also possible for the already foamed material to be heated. In this case, the various media can be fed to the housing 4 under control, in order to be able to set a desired mixing ratio.

The nozzle 1 or the foaming units 14 can be used in particular for the location-independent application of foamed material. For example, it is possible thereby to produce constructional materials of constant quality, above all when the latter are needed on rough ground or in relatively high stories in a building.

The nozzle 1 can also be used for foaming plastics, for example, it being possible for the foamed plastic to be irradiated with UV light for curing, by means of an appropriate nozzle.

In the first housing part 4' (FIGS. 5 and 6), there is a first inlet duct 6, and an outlet duct 2 is arranged in the second housing part 4". The two housing parts 4', 4" are joined to each other in a sealed manner and form between them an annular chamber 9, in which there is an annular component 7 provided with ducts 5, 5' and a duct 20. The ducts 5, 5' for introducing at least one further medium or a mixture of further media are connected to further inlet ducts 8, 8'.

The annular component 7 is a separately replaceable part. The ducts 5, 5', which are arranged in the component 7, are formed obliquely with respect to the main flow direction 26 of the media to be mixed within the component 7. In addition, the ducts 5, 5' are arranged in two separate groups in the component 7. The ducts 5 of one group are aligned obliquely in the direction opposite to the ducts 5' of the other group and, at the same time, are aligned obliquely with respect to the main flow direction 26. The groups of ducts 5, 5' can have the at least one pressurized medium applied to them, alternatively or simultaneously, via two separate inlet ducts 8, 8' arranged in the housing parts 4', 4". Depending on the desired level of foaming or mixing, a specific annular component 7 can be used, which has an appropriate arrangement of ducts 5, 5', diameter of the ducts 5, 5', number of ducts 5, 5' and the like.

By closing the one inlet duct 8 with a blind plug 27 (cf. FIG. 6) and feeding the medium through the other inlet duct 8', the injection of the medium is carried out only counter to the main flow direction.

In both the exemplary embodiments according to FIGS. 5 and 6, the annular component 7 is designed mirror-symmetrically with respect to its duct arrangement, which is advantageous in particular when the injection direction of the medium is merely to be turned. The component 7 has at its ends circumferential annular chambers 28, 28', whose respective open groove outer sides 29 are substantially aligned with the inlet ducts 8, 8'. The annular chambers 28, 28' have a wedge-like cross section. As a result, the air fed in through the inlet ducts 8, 8' is led to the ducts 5, 5' directly and in an optimum way. The bottoms 30 of the annular chambers form wedge faces which run from the front sides 31 of the component 7 to the inlet openings 29, of the ducts 5, 5'.

The axes of the ducts 5, 5' form an acute angle $\alpha$ with the main flow direction 26 and, as a result of the associated oblique entry of the injected medium, ensure a high level of foaming or mixing.

Depending on the desired foaming or mixing effect, the angle $\alpha$ between the axes of the ducts 5, 5' of the two groups may be different, based on the main flow direction 26. Likewise, the ducts 5, 5' of the two groups can also have a different diameter. Furthermore, the number of ducts 5, 5' in the two groups can be different.

As can be seen clearly in FIGS. 5, 6, the two housing parts 4', 4" rest on each other in a sealing manner with their ends 32, 33 enclosing the annular chamber 9, in order to prevent uncontrolled emergence of the injected or the mixed medium.

For this purpose, a ring-like sealing element 35, in particular an O ring, is arranged in the joint region 34 between the two housing parts 4', 4". In order to achieve a high level of sealing, the two housing parts 4', 4" can be clamped together by means of screws and exert pressure on the ends of the annular component 7 and on the sealing element 35.

In the design variant according to FIG. 5, the first housing part 4' has an inlet duct 6 which is substantially aligned with the duct 20 of the annular component 7, and the second, identical housing part 4" has an outlet duct 2 that is substantially aligned with the duct 20 of the component 7.

In the design variant according to FIG. 6, the housing part 4" has an outlet duct 2 that is substantially aligned with the duct 20, and the housing part 4' has a mixing chamber 36 like a blind hole, which the first inlet duct 8 enters laterally. The mixing chamber 36 leads to swirling of the injected medium in the duct 20 and therefore affects the foaming or mixing behavior accordingly.

A construction of this type is suitable in particular for spray cans. The entire nozzle 1 is then advantageously constructed in miniaturized form. Depending on the requirement, of course, the duct 20 can also serve as an outlet duct and the outlet duct 2 as an inlet duct.

In both the exemplary embodiments, the inlet and outlet ducts 6, 2 that are aligned with the duct 20 of the component 7 widen outward in the manner of a cone in the housing parts 4', 4" and thus ensure optimum flow conditions in these areas.

In order to increase the formation of foam or the level of misting or spraying, an element 38 provided with a plurality of openings 37 is arranged at the inner end of the outlet duct 2 in FIG. 5.

The two housing parts 4', 4" can be mounted on each other in a multiplicity of rotational positions, so that, firstly, mounting is made easier and, secondly, the nozzle 1 can be matched particularly simply to its surrounding elements (for example lines).

Figure 7:
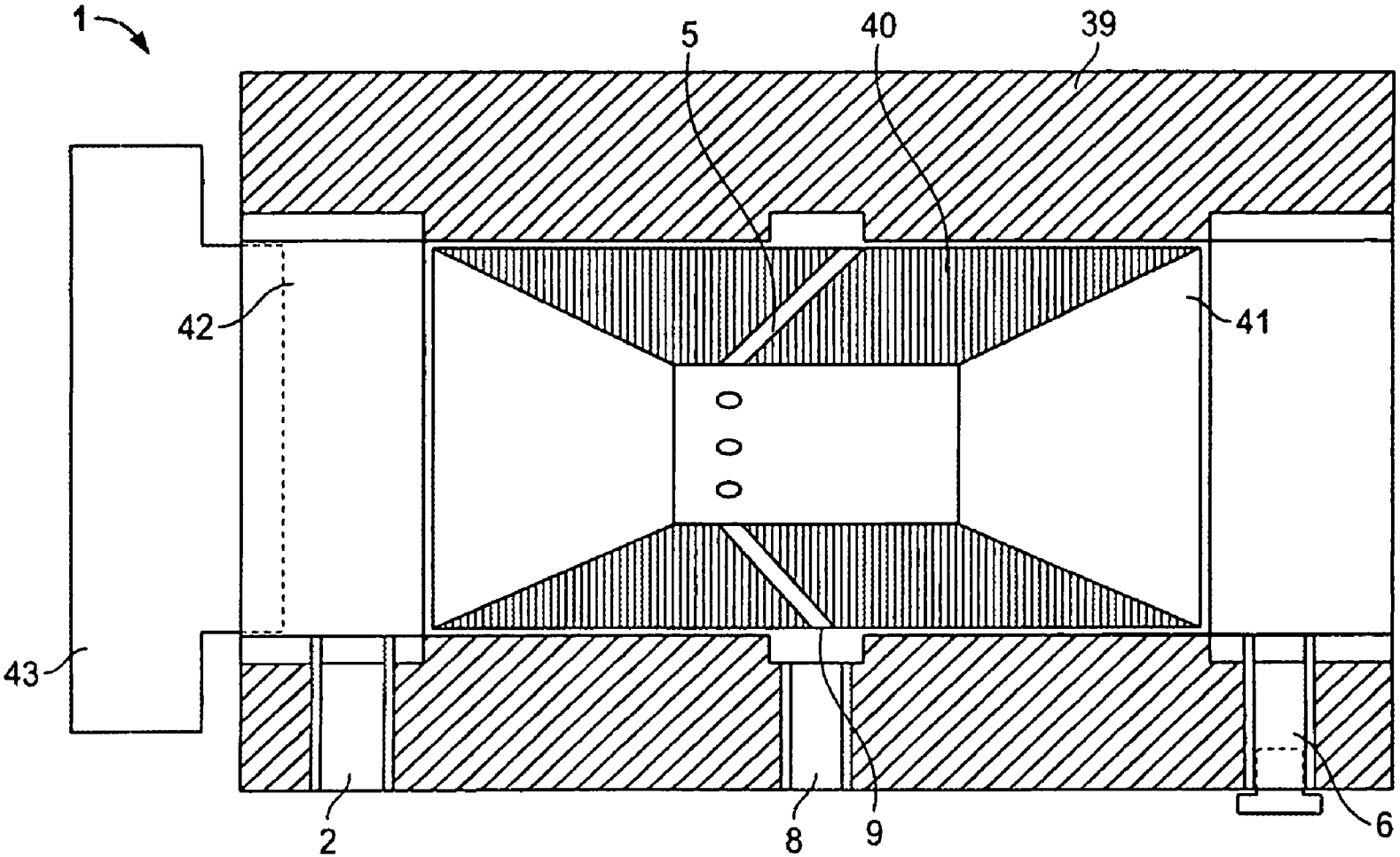
FIG. 7 shows a nozzle of another design in section.

FIG. 7 shows a nozzle having a housing 39 with an inserted, annular component 40. Inlet and outlet ducts 41 and 42 are provided for the first medium and/or foam. The ducts 41, 42 can optionally be closed by a plug 43. Ducts 5 for feeding the gaseous, second medium open into the component 40.

The alternative nozzles of FIGS. 8–13 slow single-part production. In this case, the metering of the second medium is carried out via at least one inlet 8, which does not open into an annular chamber but is connected directly to an obliquely inwardly directed duct 5. The latter leads the medium radially, obliquely or tangentially into the duct chamber 20 of the nozzle In the case of a plurality of inlets 8, 8',8", a combination of the inlet lines (centrally radially, obliquely or tangentially) is possible, depending on the intended use. The inwardly directed ducts 5, 5' can open into the duct chamber 20 of the nozzle at all possible angles.

Figure 8:
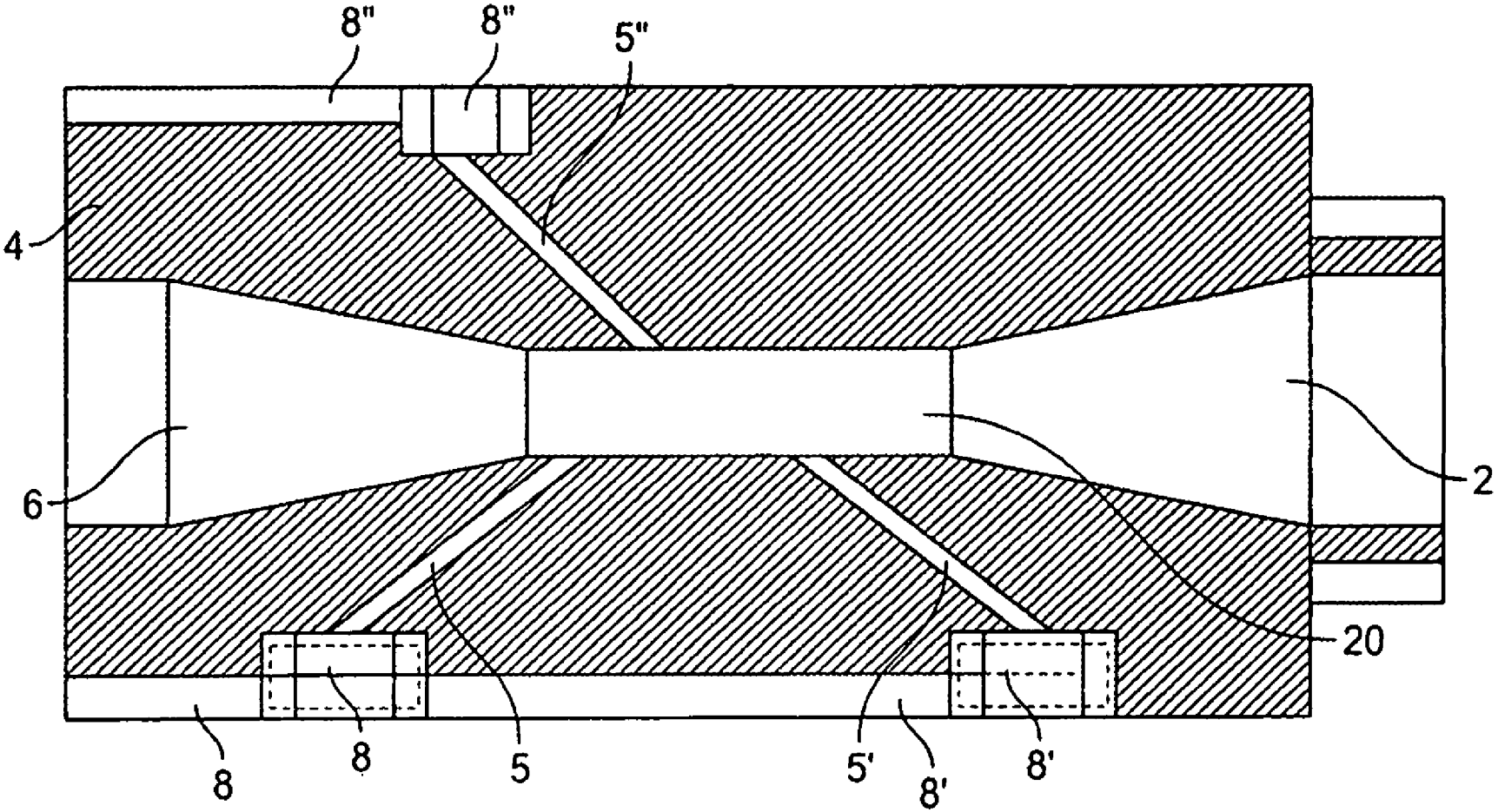
FIG. 8 shows a sectional illustration of an alterative single-part nozzle with a plurality of additional connections.

The inlets 8, 8', 8" of the nozzle of FIG. 8 can be closed by blind plugs 27 as required. Furthermore, the inlets are connected to feed lines 50 for the second medium.

Figure 9:
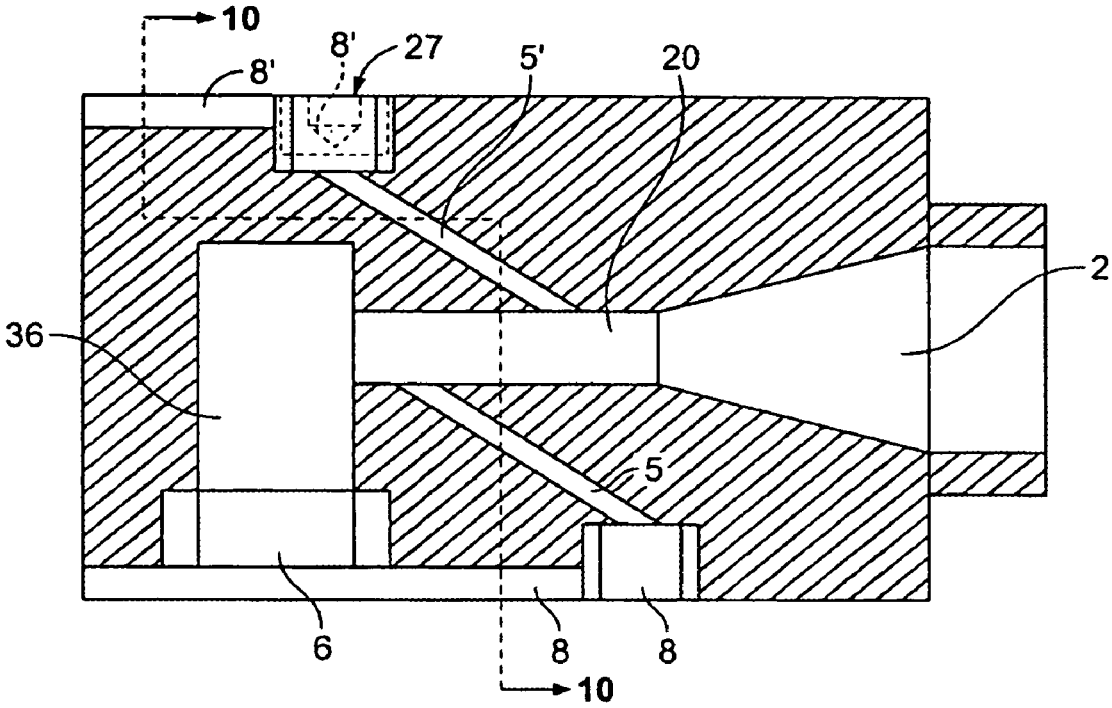
FIG. 9 shows a sectional illustration of a further alternative single-part nozzle.

FIG. 9 shows a blind hole nozzle having two inlets 8, 8' for a second medium, it being possible for one to be closed by blind plugs 27, depending on the intended use.

Figure 10:
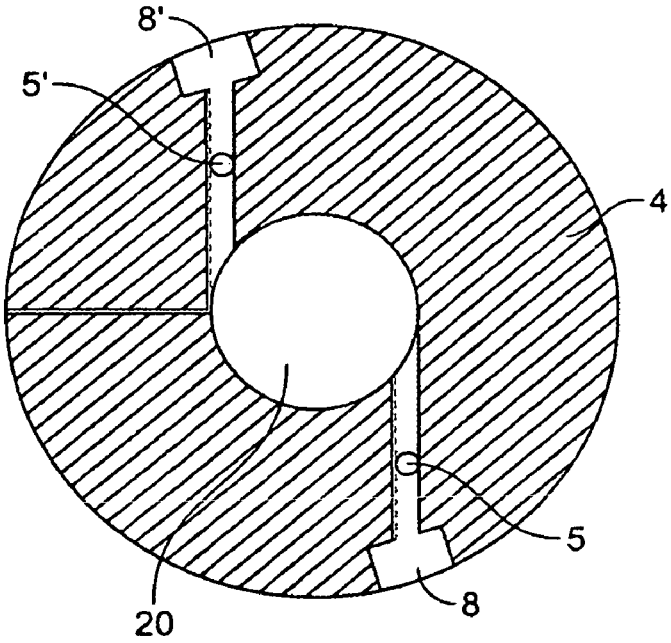
FIG. 10 shows a sectional illustration of an alternative single-part nozzle with tangentially guided ducts.

FIG. 10 shows a section through FIGS. 8 and 9 with tangential introduction of the second media into the duct chamber 20 of the nozzle.

Figure 11:
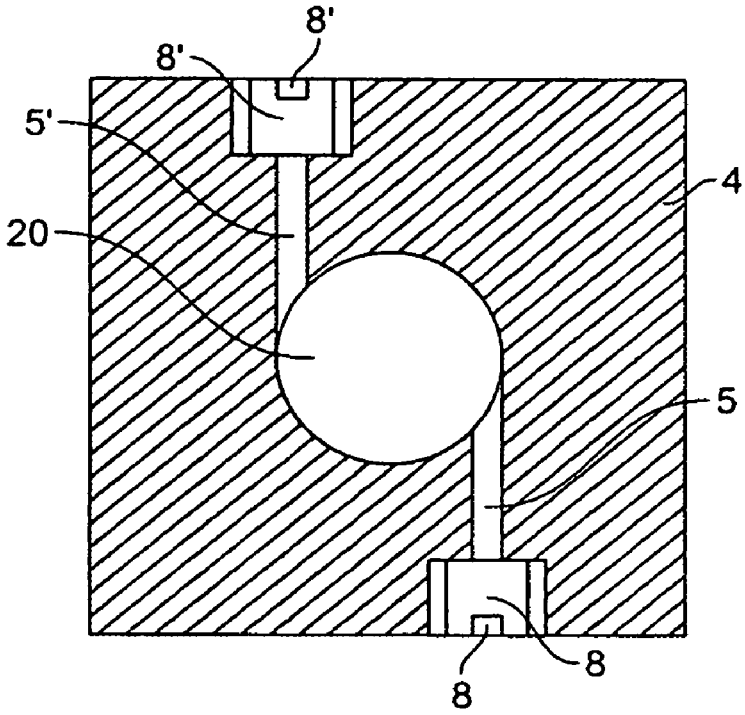
FIG. 11 shows a sectional illustration of a further alternative nozzle and FIG. 12 shows a variant of a nozzle of modified design.
Figure 12:
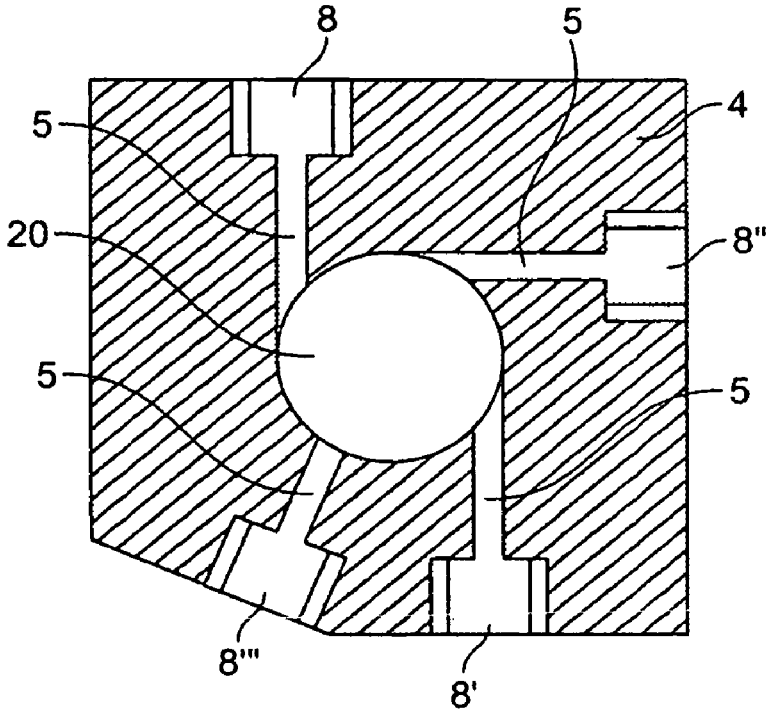

FIGS. 11 and 12 show different variants of the media feed.

Figure 13:
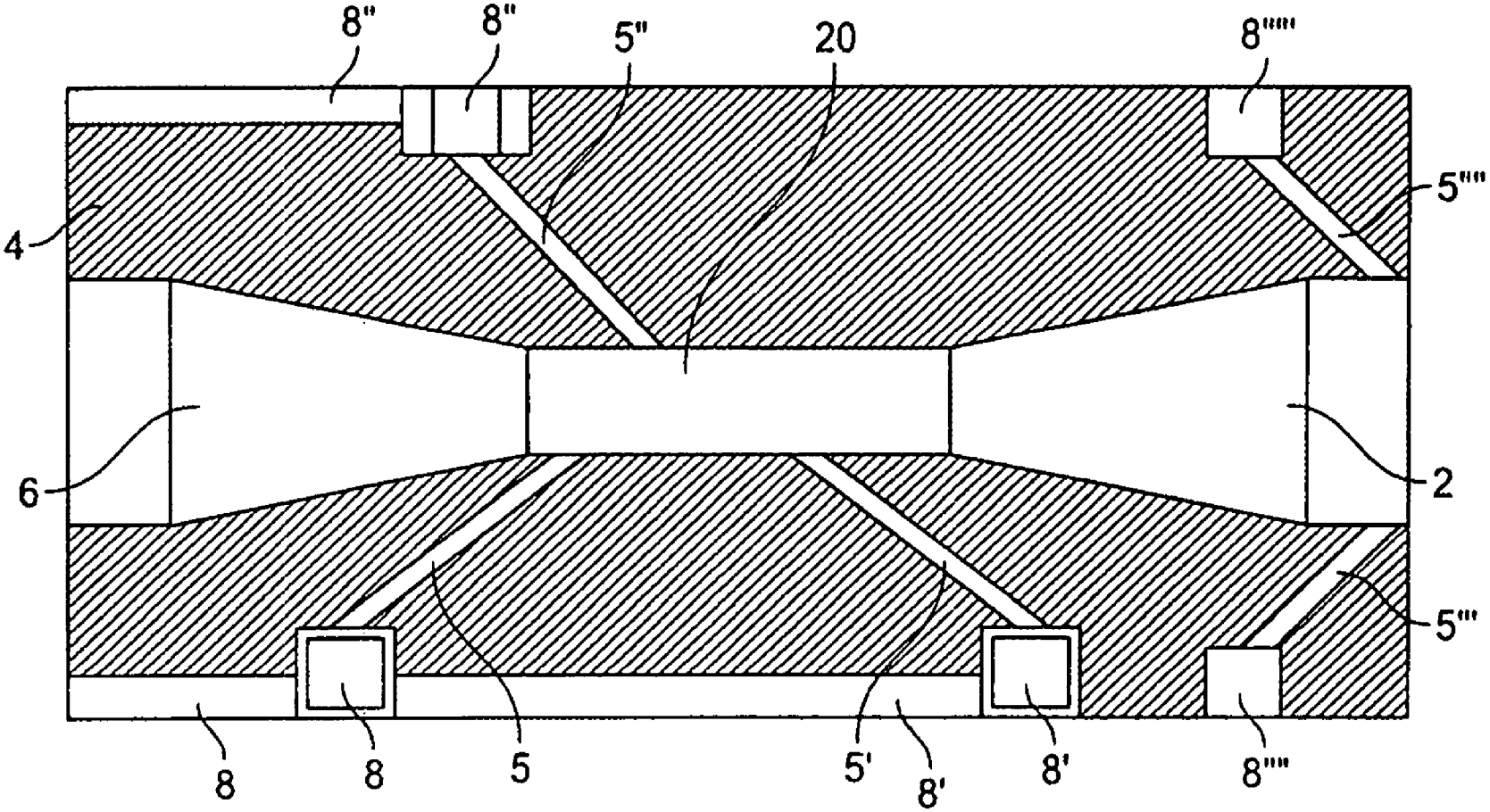
FIG. 13 shows a further variant of a nozzle.

The nozzle 4 of FIG. 13, with an intrinsically identical design to the nozzle of FIG. 8, has further inlets 8''' and 8'''' in addition to the inlets 8, 8', 8" connected to the ducts 5, 5'. The inlets 8''' and 8'''' are connected via ducts 5''' and 5'''' to the outlet duct 2, which provides the possibility of applying a coating or marking, for example, to the emergent medium. The ducts 5' and inlets 8' are shown as offset by 90°.

The invention claimed is:

1. A nozzle for foaming, spraying or misting a first media in the form of a liquid by means of at least one pressurized second medium in the form of a gas, the nozzle comprising:

a) an outlet for a foam or spray mist;

b) a disk-like element having a plurality of openings arranged at an inner end of said outlet; and c) a housing comprising:

i) at least one radially inwardly directed duct for feeding the at least one pressurized second medium; and ii) a first inlet for feeding the first media.

2. A nozzle for foaming, spraying or misting a first media in the form of a liquid by means of at least one pressurized second medium in the form of a gas, the nozzle comprising:

a) an outlet for a foam or spray mist;

b) a housing comprising:

i) a replaceable annular component arranged in said housing;

ii) a plurality of radially inwardly directed ducts for feeding the second pressurized medium arranged obliquely with respect to a main flow direction of the first media mixed within said replaceable annular component, wherein said plurality of radially inwardly directed ducts are arranged in two separate groups integrated in said annular component, said two separate groups comprising a first group and a second group, wherein said radially inwardly directed ducts of said first group are aligned obliquely in a direction opposite said radially inwardly directed ducts of said second group and obliquely with respect to said main flow direction;

iii) a first inlet for feeding the first media;

iv) a first inlet duct arranged in the housing for applying the at least one pressurized second medium to said first group of radially inwardly directed ducts; and v) a second inlet duct arranged in the housing for applying the at least one pressurized second medium to said second group of radially inwardly directed ducts;

wherein the at least one pressurized second medium may be applied to said first and said second groups of radially inwardly directed ducts simultaneously or alternatively.

3. The nozzle as claimed in claim 2, wherein at least a second inlet for feeding the second medium into at least one of said plurality of radially inwardly directed ducts is arranged laterally on said housing.

4. The nozzle as claimed in claim 2, wherein said first inlet and said outlet are arranged opposite each other in the main flow direction.

5. The nozzle as claimed in claim 2, wherein said plurality of radially inwardly directed ducts are oriented substantially counter to the main flow direction.

6. The nozzle as claimed in claim 2, wherein said plurality of radially inwardly directed ducts are oriented substantially in the main flow direction.

7. The nozzle as claimed in claim 2, wherein said plurality of radially inwardly directed ducts are configured as round bores.

8. The nozzle as claimed in claim 2, wherein said annular component is turned in said housing.

9. The nozzle as claimed in claim 2, wherein differently shaped annular components are used in said housing.

10. The nozzle as claimed in claim 2, wherein the annular component is sealed off at an inner wall of the nozzle.

11. The nozzle as claimed in claim 2, wherein a seal is provided between at least one of the annular component and the circumferential protrusion and the annular component and also the end face.

12. The nozzle as claimed in claim 2, further comprising a heating apparatus.

13. The use of the nozzle as claimed in claim 2 for a location-independent application of foamed material.

14. The use of the nozzle as claimed in claim 2 for a production of constructional materials.

15. The use of the nozzle as claimed in claim 2 for an internal coating of pipes.

16. The use of the nozzle as claimed in claim 2 for cleaning or disinfection by means of a foamed material.

17. The use of the nozzle as claimed in claim 2 to produce fire extinguishing foams.

18. The nozzle as claimed in claim 2, wherein a flow connection comprises at least one duct in said the annular component, and said duct runs obliquely with respect to the main flow direction.

19. The nozzle as claimed in claim 2, wherein said annular component is designed mirror-symmetrically with respect to said plurality of radially inwardly directed ducts.

20. The nozzle as claimed in claim 2, wherein said plurality of radially inwardly directed ducts open radially, tangentially, obliquely tangentially or perpendicularly tangentially into a duct of said annular component.

21. The nozzle as claimed in claim 2, wherein said radially inwardly directed ducts of said first group have different diameters from said radially inwardly directed ducts of said second group.

22. The nozzle as claimed in claim 2, wherein a number of radially inwardly directed ducts in said first group is different from a number of radially inwardly directed ducts in said second group.

23. The nozzle as claimed in claim 2, wherein the nozzle is configured as a single-part nozzle, and wherein said plurality of radially inwardly directed ducts open into a duct chamber tangentially, centrally and/or at all possible angles.

24. The nozzle as claimed in claim 2, wherein the nozzle has ducts additionally connected to said outlet, wherein said ducts have associated inlets, and wherein a coating and/or marking material is applied to an emergent media via said ducts.

25. The nozzle as claimed in claim 2, wherein an annular chamber, which is adjoined by said plurality of radially inwardly directed ducts, is provided between said annular component and said housing.

26. The nozzle as claimed in claim 25, wherein at least one of said annular chamber and said plurality of radially inwardly directed ducts is adjusted continuously.

27. The use of the nozzle as claimed in claim 2 for foaming plastics.

28. The use of the nozzle as claimed in claim 27, wherein the foamed plastic is irradiated with UV light.

29. The nozzle as claimed in claim 2, wherein an axes of said plurality of radially inwardly directed ducts forms an acute angle with the main flow direction.

30. The nozzle as claimed in claim 29, wherein said angle with respect to said first group of radially inwardly directed ducts is equal to or different from said angle with respect to said second group of radially inwardly directed ducts.

31. The nozzle as claimed in claim 2, wherein said annular component has at its ends two circumferential annular chambers having open groove outer sides which are substantially aligned with said first and second inlet ducts.

32. The nozzle as claimed in claim 31, wherein said two circumferential annular chambers have a wedgelike, rectangular or round cross section.

33. The nozzle as claimed in claim 31, wherein a bottom of said annular chambers forms a wedge face, which runs from said groove outer sides of said annular component obliquely toward an inlet of said plurality of radially inwardly directed ducts.

34. The nozzle as claimed in claim 2, wherein said housing is constructed in two parts and said annular component is arranged substantially between said two parts.

35. The nozzle as claimed in claim 34, wherein said two parts of said housing are screwed together, so that said two parts at least partly overlap, and said annular component is arranged between a circumferential protrusion on one of said two parts and an end face of another of said two parts.

36. The nozzle as claimed in claim 34, further comprising a UV emitter.

37. The nozzle as claimed in claim 34, wherein said second inlet is arranged laterally on one of said two parts of said housing.

38. The nozzle as claimed in claim 34, wherein a first part of said two parts has an outlet or inlet duct that is substantially aligned with a duct of said annular component, and a second part of said two parts has a mixing chamber formed as a blind hole, which first inlet or outlet duct enters laterally.

39. The nozzle as claimed in claim 34, wherein said two parts rest on each other in a sealing manner with their ends enclosing a holding chamber, and wherein a ring-like sealing element is arranged in a joint area between said two parts.

40. The nozzle as claimed in claim 34, wherein said two parts are mounted on each other in a plurality of rotational positions.

41. The nozzle as claimed in claim 34, wherein a first part of said two parts has an outlet duct that is substantially aligned with a duct of said annular component, and a second part of said two parts has an inlet duct that is substantially aligned with said duct of said annular component.

42. The nozzle as claimed in claim 41, wherein said inlet and outlet ducts that are aligned with said duct of said annular component widen outward in the manner of a cone in said two parts of said housing.

43. A foaming unit comprising a nozzle as claimed in claim 2, and lines connecting the nozzle to storage containers for the first media and second medium.

44. The foaming unit as claimed in claim 43, wherein at least one pressure regulator for a defined feeding of a respective medium is connected upstream of the nozzle.

45. The foaming unit as claimed in claim 43, wherein a second foaming apparatus or foaming unit is connected to the nozzle, the foaming being carried out by means of the foamed material from the second foaming apparatus.

46. The foaming unit as claimed in claim 43, wherein a remixer is connected downstream of the nozzle.

47. The foaming unit as claimed in claim 43, wherein the nozzle has a metering appliance connected upstream of it.

48. The foaming unit as claimed in claim 47, wherein said lines are provided on said metering appliance.

49. The foaming unit, as claimed in claim 47, wherein a metering of different initial components is set on said metering appliance.

50. The foaming unit as claimed in claim 47, wherein said metering appliance operates with a hydraulic drive.

51. The foaming unit as claimed in claim 50, wherein a metering is set by means of said hydraulic drive.

* * * * *

UNITED STATES PATENT AND TRADEMARK OFFICE

CERTIFICATE OF CORRECTION

PATENT NO. : 7,040,551 B2
APPLICATION NO. : 10/240893
DATED : May 9, 2006
INVENTOR(S) : Rummel It is certified that error appears in the above-identified patent and that said Letters Patent is hereby corrected as shown below:

In particular, in Column 14, line 44 (line 2 of Claim 18), after the word "said" please delete the word: "the".

Signed and Sealed this

Ninth Day of January, 2007

JON W. DUDAS
*Director of the United States Patent and Trademark Office*